US005977693A

United States Patent [19]

Nakamoto et al.

[11] Patent Number: 5,977,693

[45] **Date of Patent: *Nov. 2, 1999**

[54] MICRO-VACUUM DEVICE

[75] Inventors: Masayuki Nakamoto, Chigasaki; Hiromichi Ohashi, Yokohama, both of Japan

[73] Assignee: Kabushiki Kaisha Toshiba, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/526,452

[22] Filed: Sep. 11, 1995

[30] Foreign Application Priority Data

Sep. 19, 1994 [JP] Japan ..... 6-222774

[51] Int. Cl.[6] ..... H01J 1/30

[52] U.S. Cl. ..... 313/45; 313/41; 313/309; 313/311; 313/336; 313/351; 313/496

[58] Field of Search ..... 313/309, 310, 313/336, 351, 495, 496, 39, 40, 41, 45, 311

[56] References Cited

U.S. PATENT DOCUMENTS

| | | | |
|---|---|---|---|
| 5,012,153 | 4/1991 | Atkinson et al. | 313/336 |
| 5,138,220 | 8/1992 | Kirkpatrick | 313/309 |
| 5,150,019 | 9/1992 | Thomas et al. . | |
| 5,300,853 | 4/1994 | Watanabe et al. | 313/309 |
| 5,397,957 | 3/1995 | Zimmerman | 313/309 |
| 5,569,973 | 10/1996 | Zimmerman | 313/309 |

OTHER PUBLICATIONS

Uniform, Stable and High Integrated Field Emitter Arrays for High Performance Displays and Vacuum Microelectronincs Switching Devices, Nakamoto et al, pp. 29.3.1–29.3.4, Dec. 1997.

C. A. Spindt et al., Physical Properties of Thin–Film Field Emission Cathodes with Molybdenum Cones; Journal of Applied Physics, vol. 47, No. 12, Dec. 1976, pp. 5248–5263.

Junji Itoh, Vacuum Microelectronics; Applied Physics, vol. 59, pp. 164–169, Dec. 1990.

*Primary Examiner*—Ashok Patel
*Attorney, Agent, or Firm*—Oblon, Spivak, McClelland, Maier & Neustadt, P.C.

[57] ABSTRACT

A micro-vacuum device comprises a substrates an emitter having a sharp end formed above the substrate, a gate electrode provided above the emitter, and an anode having cooling means provided oppositely to the substrate above the gate electrode.

28 Claims, 7 Drawing Sheets

MICRO-VACUUM DEVICE

BACKGROUND OF THE INVENTION

1. Field of the Invention

The present invention relates to a micro-vacuum device, and more particularly to a micro-vacuum device for large power or highly integrated large capacity.

2. Description of the Related Art

Recently, the development of a micro-vacuum tube using a field emission type cold cathode using developed Si semiconductor processing technique has been actively pursued. A conventional thermal cathode vacuum tube is used in a current density up to about 50 A/cm$^2$ and a semiconductor device is usually used in a current density 10 to 20 A/cm$^2$ about 100 A/cm$^2$ at most, whereas a micro-vacuum microelement using this micro-vacuum tube technique is expected for use in a current density to 1,600 A/cm$^2$ or more.

A representative example of such a micro-vacuum tube was disclosed in Journal of Applied Physics, Vol. 47, page 5248 (1976). A conical emitter for emitting electrons by an electric field formed in this field emission type cold cathode by a rotary oblique vapor-depositing method is known.

A representative example in which its anode is formed was disclosed in Applied Physics, Vol. 59, page 164 (1990), and Si field emission type cold cathode and an anode formed by using Si anisotropic etching is known.

A main section of this micro-vacuum tube has a structure as shown in FIG. 1. Above an Si substrate 1, a quadrangular pyramidal emitter 2 formed by Si anisotropic etching for emitting electrons is formed, and an insulating layer 3, a gate electrode layer 4, an insulating layer 5 and an anode 6 are sequentially laminated to be formed on a periphery of the emitter 2. They are contained in a vacuum vessel 7. The gate electrode layer 4 controls emission of electrons of the emitter 2. The electrons emitted from the emitter 3 are received by an anode 6.

Heretofore, a cold cathode using the abovedescribed emitter and gate electrodes has been applied to a limited example such as, for example, a display unit.

The conventional micro-vacuum tube obtains a large current density of 1,000 A/cm$^2$ or more, though a power switching element such as a GTO (Gate Turn-Off thyristor) obtains a current density of about 10–20 A/cm$^2$ at the time of operating the power switching element such as the GTO. Then, when a micro-vacuum tube having an on voltage of 2 V in the case of a current density of about 100 to 200 A/cm$^2$ is formed, heat loss of energy loss particularly occurs at the time of operating. Thus, heat up to 200 to 400 W/cm$^2$ is generated.

In this case, electrons transited in vacuum dissipate energy on a metal surface of its anode to abnormally increase its temperature, resulting in fracture and damage due to heat generation and fracture due to such as sputtering. Simultaneously, the emitter and gate electrodes are heated by heat radiation of the anode, and problems such as a current concentration at the emitter at a center of the cathode, adverse influence to other electronic devices, an electronic circuit connected to or installed at the periphery of the micro-vacuum tube occur.

SUMMARY OF THE INVENTION

It is therefore an object of the present invention to provide a novel micro-vacuum tube in which generation of heat can be, even if a current density is large, suppressed and which can be used with a large current and sufficiently used as an element for switching at a high speed with high withstand voltage.

According to one aspect of the present invention, there is provided a micro-vacuum device comprising:

a substrate;

an emitter formed on the substrate and having a sharp tip;

a gate electrode formed in a region except a tip region of the emitter above the substrate;

an anode provided at a position opposed to a surface formed with the emitter and gate electrodes of the substrate; and cooling means for cooling the anode.

According to second aspect of the present invention, there is provided a micro-vacuum device comprising:

a substrate;

an emitter formed on the substrate and having a sharp tip;

a gate electrode formed in a region except a tip region of the emitter above the substrate; and an anode provided at a position opposed to a surface formed with the emitter and gate electrodes of the substrate and essentially consisting of semiconductor material.

According to third aspect of the present invention, there is provided a micro-vacuum device comprising:

a substrate;

a plurality of emitters formed on the substrate and having a sharp tip including an array of a dense distribution from a center to a peripheral edge of the substrate;

a gate electrode formed in a region except a tip region of the emitter above the substrate; and an anode provided at a position opposed to the substrate above the emitter and gate electrodes.

According to fourth aspect of the present invention, there is provided a micro-vacuum device comprising:

a substrate;

an emitter having a sharp tip formed on the substrate;

a gate electrode formed in a region except a tip region of the emitter above the substrate; and a dome-shaped anode provided at a position opposed to a surface formed with the emitter and gate electrodes of the substrate.

According to a fifth aspect of the present invention, there is provided a micro-vacuum device comprising:

a substrate;

an emitter having a sharp tip formed on the substrate;

a gate electrode formed in a region except a tip region of the emitter above the substrate; and an anode provided at a position opposed to a surface formed with the emitter and gate electrodes of the substrate and containing a material selected from a group consisting of thermal conductive sintered material and porous conductive material.

The micro-vacuum device of the present invention can sufficiently suppress, even if a current density to be used is large, heat generated at the anode, the emitter and the gate electrodes in the vacuum device. Therefore, the micro-vacuum device can be used with a large current, has a high withstand voltage and can be sufficiently used as an element capable of switching at a high speed. Further, variations in electron emission characteristics of the emitter due to local heat generation and current concentration on the surface of the anode are prevented, and, additionally adverse influence of heat generation to a peripheral equipment can also be prevented.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
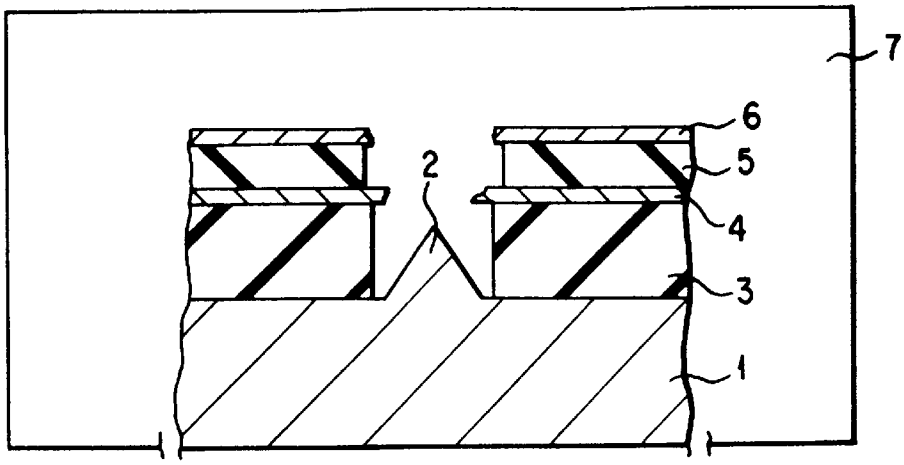
FIG. 1 (PRIOR ART)
FIG. 1 is a schematic view showing an essential section of a conventional micro-vacuum tube.

The inventors of the present invention have utilized one particular fact in completing the present invention. Specifically, they have noted that a solid state device has both electrons and holes as carriers which move in a solid such as a semiconductor with energy losses caused by vibration of the lattice when the carriers move. Most of the heat generation of such a device occurs in the solid. This is different from a micro-vacuum tube which utilizes only electrons as carriers and has a vacuum between the emitter and the anode. As a result, the energy loss occurs due to electron collision energy at the anode, which receives the electrons emitted from the emitter.

The present invention is largely classified to first to fifth aspects.

A main structure of a micro-vacuum device according to the first to fifth aspects of the present invention comprises:

a substrate an emitter formed in a region except a tip region of an emitter above the substrate; and an anode provided at a position opposed to the substrate above the emitter and gate electrodes.

The emitter can be formed, for example, in a quadrangular pyramidal shape.

The emitter may be formed of tungsten, molybdenum, silicon, tantalum or lanthanum boride.

The micro-vacuum device according to the first to the fifth aspects of the present invention has features, in addition to the above main structure.

According to the first aspect of the present invention, cooling means for cooling the anode is provided.

A heat radiating fin can be used as the cooling means.

Other cooling means for cooling the emitter and gate electrodes is further provided in the micro-vacuum device.

According to the second aspect of the present invention, the anode consists essentially of semiconductor.

The micro-vacuum device according to the second aspect of the present invention may comprise cooling means to be used for such micro-vacuum device according to the above-described first aspect.

As the semiconductor, silicon or gallium arsenide can be, for example, employed. This semiconductor may be single crystalline, polycrystalline and amorphous. Metals may be dispersed in the semiconductor or laminated as a metal layer on the semiconductor.

As the semiconductor material, a graded material so doped with an impurity as to have a concentration gradient in a thickness direction of the anode can be applied to the semiconductor. Such an impurity includes boron or phosphorus.

A backing layer made preferably of metal is provided at the semiconductor anode. As such metal, aluminum, copper, gold, nickel, iron, stainless steel, and the like which is good in heat dissipation may be used.

According to the third aspect of the present invention, an emitter array is so disposed that its distribution becomes dense from a center of the substrate to a peripheral edge of the substrate.

The cooling means to be used for the micro-vacuum device according to the first aspect as described above can be provided also in the micro-vacuum device according to the third aspect.

According to the fourth aspect of the present invention, its anode has a dome shape.

The cooling means to be used for the micro-vacuum device according to the first aspect as described above can be provided also in the micro-vacuum device according to the fourth aspect.

According to the fourth aspect of the present invention, its anode contains sintered material or porous conductive material.

The cooling means to be used for the micro-vacuum device according to the first aspect as described above can be provided also in the micro-vacuum device according to the fifth aspect.

As the sintered material, silicon nitride, aluminum nitride or silicon carbide can be used.

As the porous conductive material, porous silicon, porous gold, porous aluminum, having porosity of 20 to 80% may be used.

The anode containing the sintered material preferably has a backing layer containing metal. The backing layer preferably contains a filler which contains metal selected from aluminum and copper, and filler containing similar composition to the sintered material component. A difference of thermal expansion coefficients is reduced by including such a filler, and damage, fracture between the backing layer and the sintered material layer can be prevented.

According to the present invention in accordance with the first to fifth aspects of the invention, following functions are provided.

According to the first aspect of the present invention, since the anode is cooled by the cooling means, heat generated from the anode can be suppressed, even if electrons emitted from the emitter reach the anode. Thus, abnormal temperature rise, damage and fracture of the anode can be avoided.

According to the second aspect of the present invention, electrons emitted from the emitter are introduced in an extremely shallow depth of about 0.1 $\mu$m to the metal anode, but are introduced in a depth of 5 to several tens $\mu$m to the anode containing semiconductor. Therefore, heat generated in the anode is widely diffused and absorbed to prevent local heating of the vicinity of a surface of the anode. Thus, damage or fracture of the anode can be avoided.

According to the third aspect of the present invention, emission of electrons in a surface of the substrate can be made uniform by preventing concentration of a current at a center of the substrate in which radiation heat from the anode is scarcely dissipated. The emitter has a property of easily emitting electrons by radiating heat from the anode around the center of the substrate and the heat is hardly dissipated from the center of the substrate, and hence the electrons are easily emitted from the emitter of its center as compared with that of the periphery. According to the third aspect of the present invention, heat is raised at the center of the substrate by more densely arraying an emitter array at its peripheral edge as compared with the center, and change in electron emission characteristics of the emitter can be prevented. Thus, local temperature rise of the anode and damage, and fracture of the anode due to the local temperature rise can be avoided.

According to the fourth aspect of the present invention, the anode has a dome shape. Thus, since a distance in which the electrons radially emitted from the emitter reach the anode can be substantially uniformly adjusted, heat generated from the anode can be prevented from being raised at a center of the micro-vacuum tube. In this manner, electron emitting characteristics of the emitter are varied at its center to prevent a current from being concentrated at the center of the substrate, thereby avoiding damage or fracture of the anode.

According to the fifth aspect of the present invention, the anode contains sintered material or porous conductive material having high thermal conductivity. Therefore, heat is easily diffused in the sintered material having the high thermal conductivity, whereas the electrons are introduced to pores of the porous conductive material, and hence heat is generated in a region of a deeper depth than that of metal which is not porous and can be absorbed. Thus, generation of local heat and hence damage or fracture of the anode can be avoided.

The present invention will be described in more detail with reference to the accompanying drawings.

A micro-vacuum tube according to the first aspect of the present invention will be described.

Figure 2:
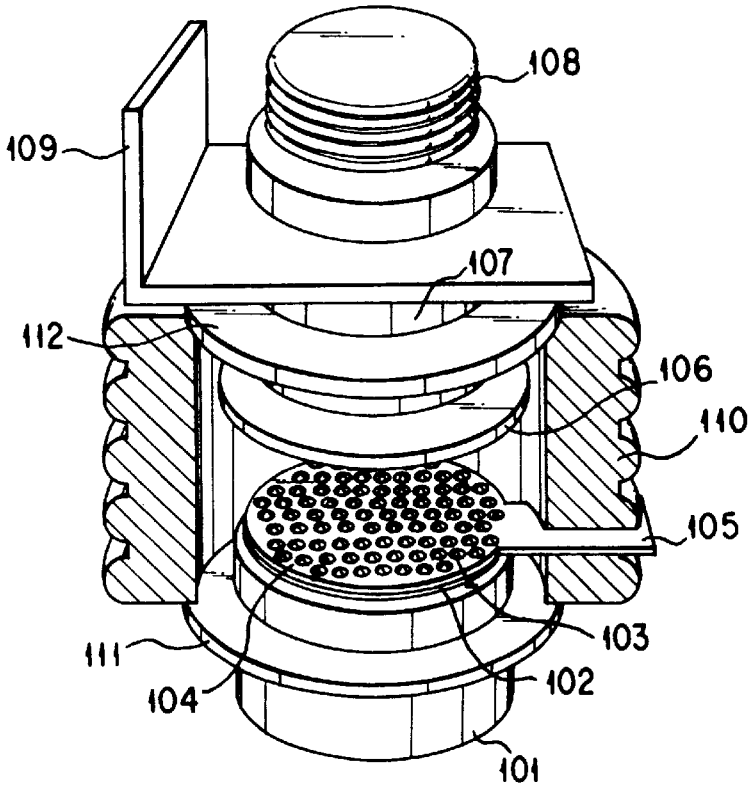
FIG. 2 is a perspective sectional view showing a first example of a micro-vacuum tube according to a first aspect of the present invention.

FIG. 2 shows a perspective sectional view of a first example of a micro-vacuum tube according to the present invention.

In FIG. 2, a substrate 102 is installed on a block 101. A plurality of quadrangular pyramidal emitters 103 formed by a transfer molding method are formed above the substrate 102, and a gate electrode 104 is so provided as to expose the tip of the emitters 103. The gate electrode 104 is externally connected by a gate terminal 105. An anode 106 is provided at a position opposed to the substrate 102, and the anode 106 is connected to a block 107 by press bonding or brazing. A thermal capacity of a block 101 and 107 is so increased as to endure against a large current. Heat dissipating fins 108 in which at least parts are threaded are provided as first cooling means at an upper portion of the block 107, and an anode terminal 109 which performs a role of dissipating heat is provided at a center thereof.

A space between the emitters 103, the gate electrode 104 and the anode 106 is formed in a vacuum state by using a high-insulation ceramic enclosure 110 of a heat dissipating and cooling fin structure at a surface of its outer periphery and metal seals 111 and 112 used also as vacuum-sealing and heat dissipating.

More specifically, a pressure resistance between the emitter 103, the gate electrode 104 and the anode 106 is set to 1 kV, and an interval between the emitter 103, the gate electrode 104 and the anode 106 is set to about 100 $\mu$m. a vessel is evacuated in vacuum up to a pressure of $1.3\times10^{-7}$ Pa, and then the ceramic enclosure 110 is connected to the metal seals 111 and 112. Thus, the micro-vacuum tube according to this embodiment is completed.

A manufacturing process of a cold cathode including a plurality of emitters and a gate electrode by a transfer molding method will be described. FIGS. 3A to 3I are views for explaining the manufacturing process of the cold cathode using the transfer molding method.

Figure 3A:
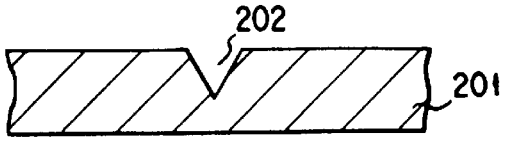
FIGS. 3A to FIG. 3I are views for explaining manufacturing steps of a cold cathode using a transfer molding method.

First, as shown in FIG. 3A recess sharpened at its bottom is formed on a surface of one side of a single crystalline substrate having a diameter of about 10 cm. As a method for forming such a recess, there is provided a method which uses anisotropic etching of an Si single crystalline substrate as will be described. An $SiO_2$ layer (not shown) having a thickness of 0.1 $\mu$m is formed on a p-type Si single crystalline substrate 201 having a crystal orientation (100) by a dry oxidation method, and coated with resist (not shown) by a spin coating method. Then, after the substrate 201 is so patterned such as exposed and developed as to obtain, for example, an opening of a square having one side of 1 $\mu$m by using a stepper, the $SiO_2$ layer is etched by an $NH_4F$ and HF mixture solution. After the resist is removed, the substrate 201 is anisotropically etched by KOH aqueous solution containing 30 wt. % of KOH, and a recess 202 of an inverted pyramid shape having a depth of 0.71 $\mu$m is formed on the Si substrate 201.

Figure 3B:
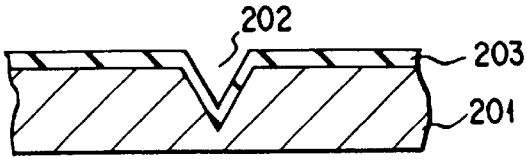

Then, after the $SiO_2$ layer is removed, an $SiO_2$ layer 203 including the recess 202 is formed, as shown in FIG. 3B, on the Si substrate 201 including the recess 202. According to this embodiment, the $SiO_2$ layer 203 is so formed as to become 0.3 $\mu$m of a thickness by a wet oxidation or the other method.

Figure 3C:
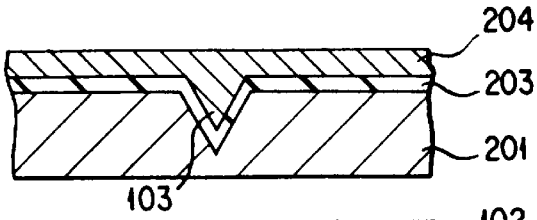

As shown in FIG. 3C, an emitter material layer 204 is so formed as to fill, for example, tungsten or molybdenum in the recess 202. According to this embodiment, the tungsten is so formed by a sputtering method that a thickness becomes 2 $\mu$m. A portion filled in the recess 202 becomes the emitter 103.

A conductive layer of ITO or the like may be formed according to a quality of the emitter material.

Figure 3D:
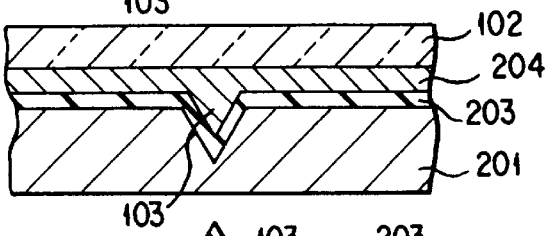

Then, as shown in FIG. 3D, a glass substrate to become the substrate 102 is adhered by an electrostatic adhering method. The glass substrate 201 is adhered by heating a pyrex glass substrate having a thickness of 1 mm and coated on its back surface with an Al layer in the state that a negative voltage is applied to the side of the glass substrate 102 and a positive voltage is applied to the side of the Si substrate 201.

Figure 3E:
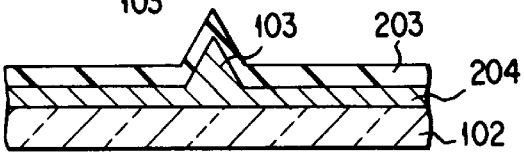

Subsequently, as shown in FIG. 3E, after the Al layer on the back surface of the glass substrate 102 is removed, only the Si substrate 201 is removed by etching with a mixture solution of ethylenediamine-pyrocatechol-pyrazine.

Figure 3F:
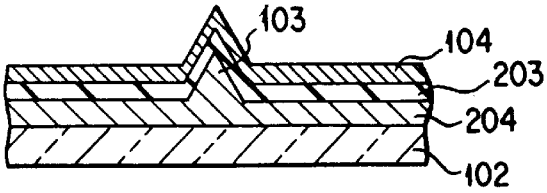

Then, as shown in FIG. 3F, tungsten is, for example, formed as the gate electrode layer 104 on the $SiO_2$ layer 203. According to this embodiment, the gate electrode layer 104 is so formed by a sputtering method that its thickness becomes 0.9 $\mu$m.

Figure 3G:
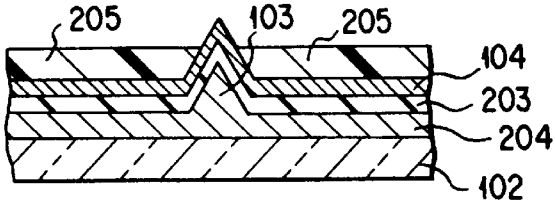

Further, as shown in FIG. 3G, the gate electrode layer 104 is coated with photoresist, etched by an oxygen plasma, and a photoresist layer 205 is so formed that an end of the emitter 103 is present at about 0.7 $\mu$m.

Figure 3H:
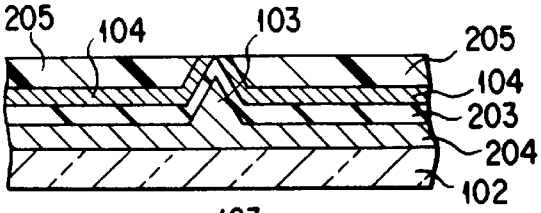

Then, as shown in FIG. 3H, the gate electrode layer 104 at the end of the emitter 103 is removed by an RIE (Reaction Ion Etching) method.

Figure 3I:
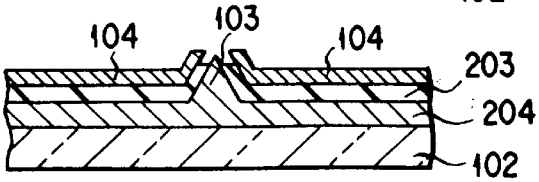

Eventually, as shown in FIG. 3I, the photoresist layer 205 is removed, and then the $SiO_2$ layer 203 at the end of the emitter 103 is removed by using a mixture solution of $NH_4F.HF$. Thus, a cold cathode including the emitter 103 and the gate electrode 104 is completed.

The emitter of this cold cathode is formed by filling a material in the recess provided on the Si substrate by anisotropic etching. Thus, the emitter responsive to the shape of the recess can be obtained with high reproducibility. Since the recess can be formed in an inverted pyramidal state in which its bottom is preferably sharpened by the reproducibility of the shape of the anisotropic etching and a growing operation of the $SiO_2$ layer to a portion to become the emitter in the recess, the tip is sharpened, and the emitter having excellent height uniformity can be stably obtained. Further, since the $SiO_2$ layer is so formed as to be interposed to be held between the end of the emitter and the gate electrode, a distance between the emitter and the gate can be accurately controlled according to the thickness of the $SiO_2$ layer. In addition, the emitter material is not limited to the tungsten and the Si, but various materials having low work function can be used. Such a cold cathode largely improves an electron emission efficiency and its uniformity. Further, since the glass substrate having high strength is used, the substrate can be increased.

When a large current of 30 kA (current density of 100 $A/cm^2$) flows at an on voltage of 2 V in the micro-vacuum tube of FIG. 2 using such a cold cathode and a high speed switching of 10 kHz is executed, an abnormal temperature rise, damage and fracture of the anode do not occur, a variation in electron emission characteristics and deterioration do not appear, and a normal operation is conducted.

As described above, since the normal operation is obtained even when the large current flows, this micro-vacuum tube can be used as a power switching element and the like.

Figure 4:
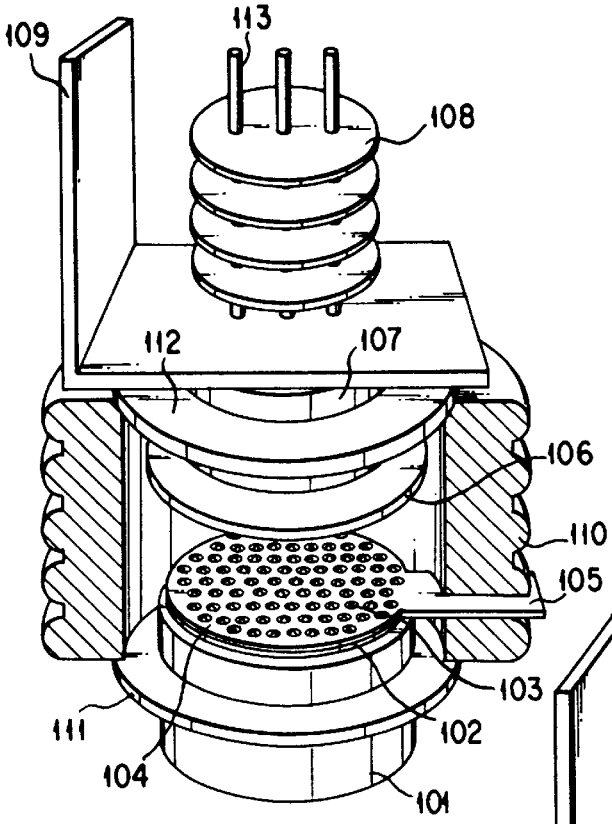
FIG. 4 is a perspective sectional view showing a second example of a micro-vacuum tube according to the first aspect of the present invention.

FIG. 4 is a perspective sectional view showing a second example of a micro-vacuum tube according to the first aspect of the present invention. The same reference numerals are employed in this micro-vacuum tube shown in FIG. 4 to designate parts or elements corresponding to those shown in FIGS. 2.

The micro-vacuum tube shown in FIG. 4 differs from the micro-vacuum tube show in FIG. 2 in that cooling means having heat pipes 113 are used for the heat dissipating fins 108. The heat pipes 113 are provided to further enhance a cooling effect due to that the heat is further easily dissipated.

Figure 5:
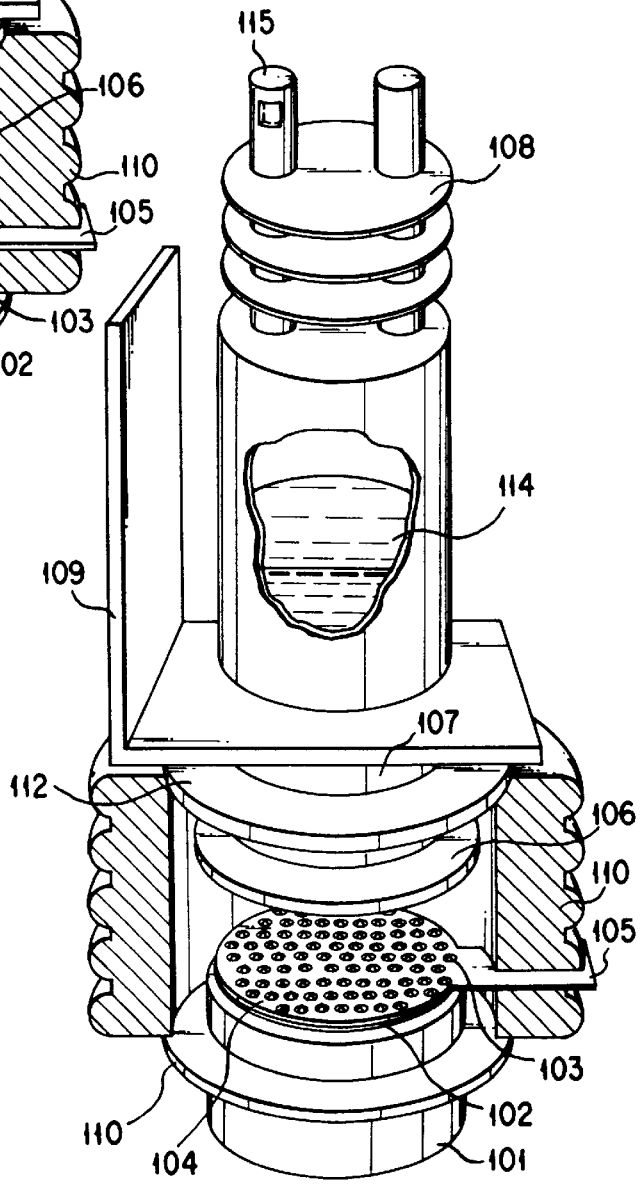
FIG. 5 is a perspective sectional view showing a third example of a micro-vacuum tube according to the first aspect of the present invention.

FIG. 5 is a perspective sectional view showing a third example of a micro-vacuum tube according to the present invention.

The micro-vacuum tube shown in FIG. 5 differs from the micro-vacuum tube shown in FIG. 2 in that a boiling pool 114 is provided in the block 107 and further cooling means having hollow pipes 115 provided at the heat dissipating fins 108 is employed. Water in the boiling pool 114 is heated by the heat generated at the anode 106 to become steam. At this time, the anode 106 is cooled by heat of vaporization. The steam rises in the hollow pipes 115 to be cooled and again becomes water, which is, in turn, returned to the boiling pool 114. The heat of the micro-vacuum tube is further easily dissipated by using such cooling means.

It is noted that water is continuously supplied not by the boiling pool but externally by a pipe to cool the anode.

Figure 6:
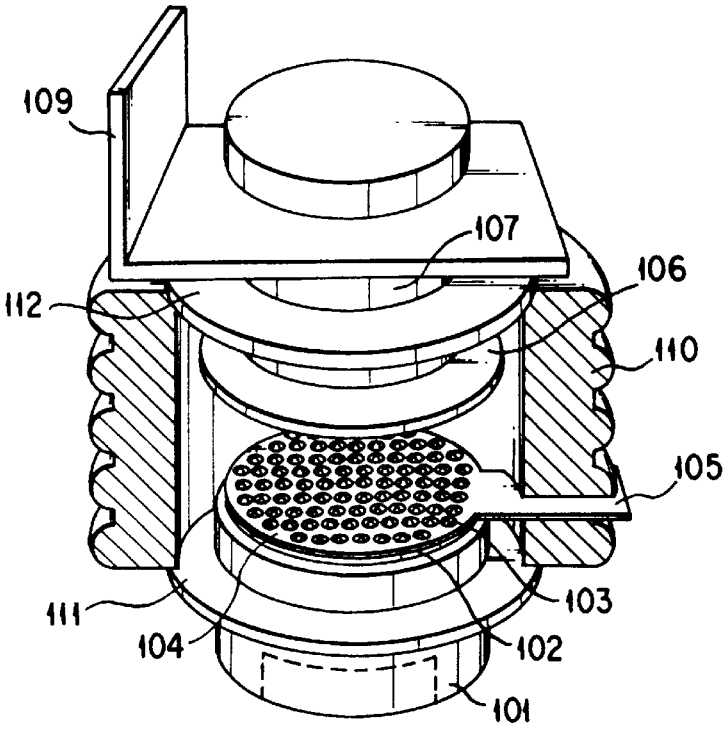
FIG. 6 is a perspective sectional view showing a fourth example of a micro-vacuum tube according to the first aspect of the present invention.

FIG. 6 is a perspective view showing a fourth example of a micro-vacuum tube according to the present invention.

The micro-vacuum tube shown in FIG. 6 differs from the micro-vacuum tube shown in FIG. 2 in that no heat dissipating fin is provided, and cooling means in which water flows in a portion surrounded by a shade of the block 101 is used.

As described above, the anode and particularly the emitter and gate electrodes are cooled, and heat generated at the emitter and gate electrodes when the emitter emits electrons and heat radiated from the anode and generated upon arrival at the emitter and the gate electrodes can be suppressed. Therefore, a variation in the electron emission characteristics can be suppressed.

In the micro-vacuum tube shown in FIG. 6, the heat dissipating fins shown in FIGS. 2, 4 and 6 may be combined.

Figure 7:
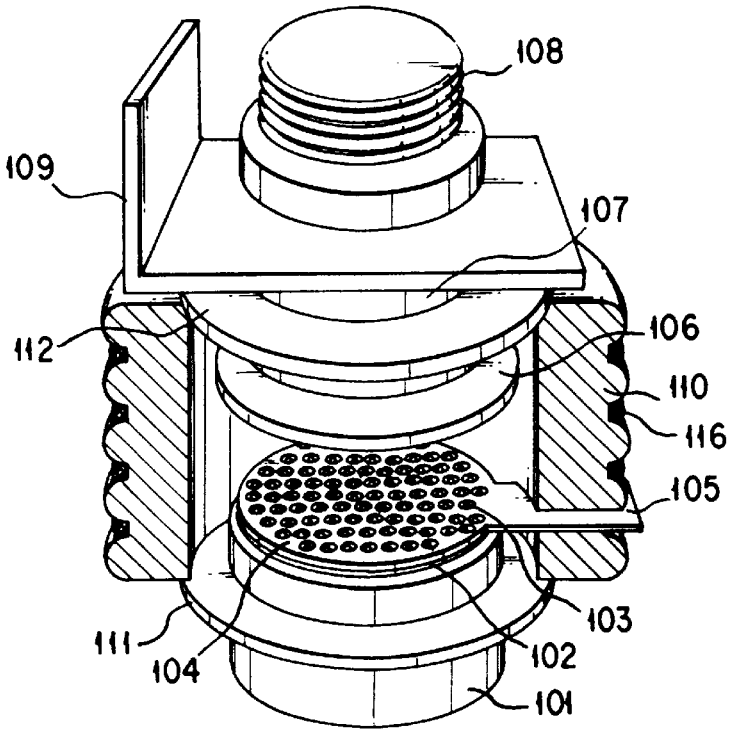
FIG. 7 is a perspective sectional view showing a fifth example of a micro-vacuum tube according to the first aspect of the present invention.

FIG. 7 is a perspective sectional view showing a fifth example of a micro-vacuum tube according to the present invention.

The micro-vacuum tube shown in FIG. 7 differs from the micro-vacuum tube shown in FIG. 2 in that a pipe 116 for flowing water is spirally wound on an exterior of the enclosure 110 to continuously flow the water, thereby cooling.

Since the pipe 116 is provided to cool the emitter 103, the gate electrode 104 and the anode 106, a cooling effect is increased as compared with the case that only the heat dissipating fins are provided.

Figure 8:
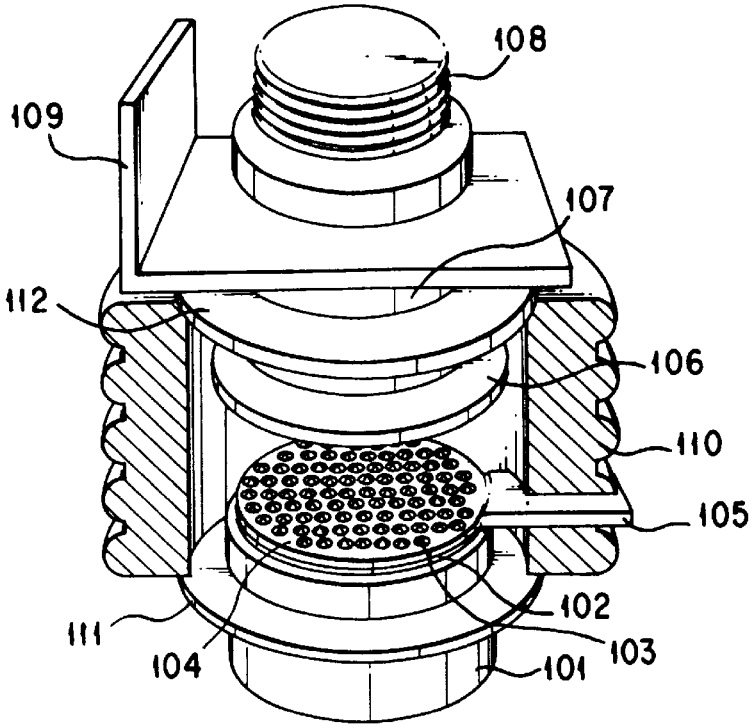
FIG. 8 is a perspective sectional view showing a sixth example of a micro-vacuum tube according to the first aspect of the present invention.

FIG. 8 is a perspective sectional view showing a sixth example of a micro-vacuum tube according to the present invention.

The micro-vacuum tube shown in FIG. 8 differs from the micro-vacuum tube shown in FIG. 2 in that a thickness of the gate terminal 105 is increased more.

In this micro-vacuum tube, the heat of the anode is dissipated by the heat dissipating fins 108, and the heat of the gate electrode is more dissipated by increasing the thickness of the gate terminal 105.

Figure 9:
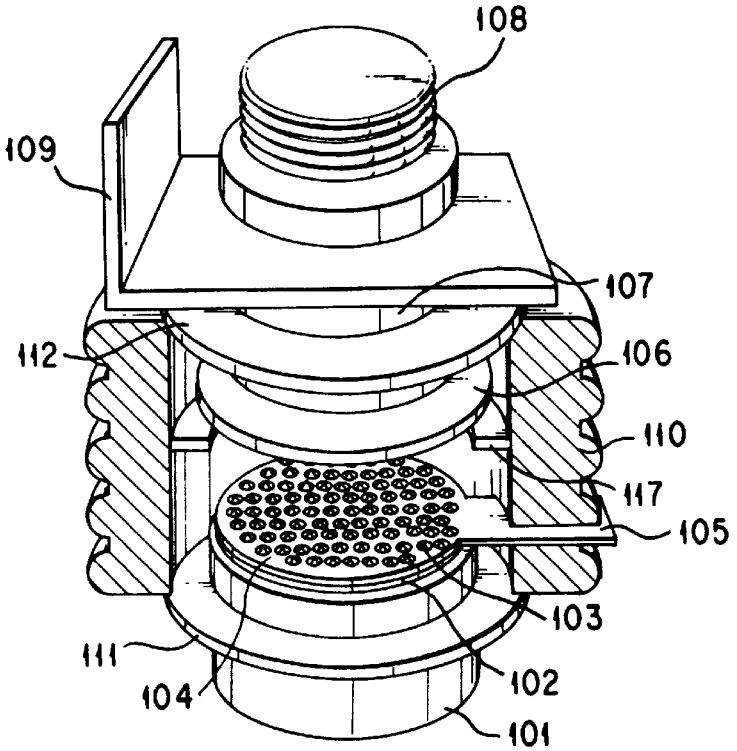
FIG. 9 is a perspective sectional view showing a seventh example of a micro-vacuum tube according to the first aspect of the present invention.

FIG. 9 is a perspective sectional view shown a seventh example of a micro-vacuum tube according to the present invention.

The micro-vacuum tube of this embodiment differs from that of the first embodiment in that a shielding plate 117 is provided between the emitter 103 and the gate electrode 104.

The shielding plate 117 performs a role of preventing arrival of the heat radiated from the anode 206 at the emitter 103 and the gate electrode 104 to a certain degree.

The cooling means used in the present invention is not limited to the above-described examples. For example, other method such as a method for cooling the micro-vacuum tube by filling the entire micro-vacuum tube in a cooling package may be employed.

In the examples described above, the cold cathode is formed by the transfer molding method. However, in addition, a rotary oblique vapor-deposition method, an Si anisotropic etching method and the like may be employed.

The examples of the micro-vacuum tube described above may be suitably combined, and the effect of the present invention can be further enhanced by the combination.

Features of the micro-vacuum tube according to the second aspect of the present invention will be described.

Figure 10:
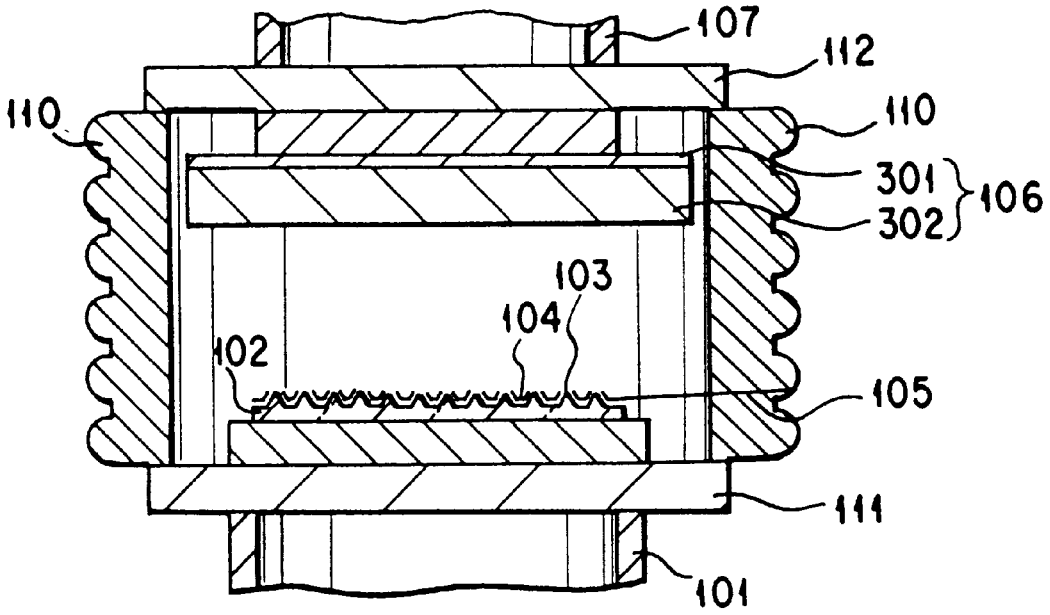
FIG. 10 is a schematic view showing a portion of a micro-vacuum tube according to a second aspect of the present invention.

FIG. 10 is a schematic sectional view showing a portion of a micro-vacuum tube according to the second aspect of the present invention. In the drawing, the same reference numerals are employed in FIG. 10 to designate parts or elements corresponding to those shown in FIG. 2.

As shown in FIG. 10, the micro-vacuum tube comprises an anode having a backing layer 301 made, for example, of copper, or aluminum and a semiconductor layer 302 made, for example, of silicon, or gallium arsenide. The semiconductor layer may be formed of a graded material in which an impurity such as phosphorus, boron or the like are so doped as to generate a concentration gradient in a thickness direction.

In the micro-vacuum tube shown in FIG. 10, electrons emitted from the emitter 104 arrive at the semiconductor layer 302, and are penetrated from its surface in a depth of 5 to 10 $\mu$m. Therefore, heat is generated more widely than an ordinary anode, and diffused and absorbed. In this manner, local heating of the anode can be prevented.

Features of the micro-vacuum tube according to the third aspect of the present invention will be described.

Figure 11:
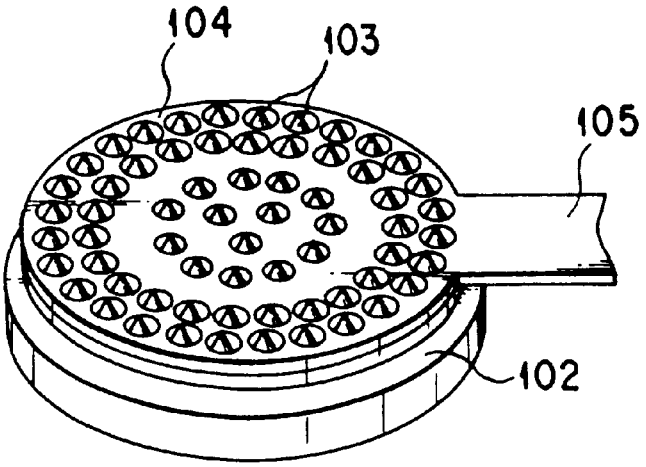
FIG. 11 is a view for explaining an array of emitters to be used for a micro-vacuum element according to a third aspect of the present invention.

FIG. 11 is a view for explaining an array of emitters to be used for the micro-vacuum tube according to the third aspect of the present invention. The same reference numerals are employed in the micro-vacuum tube shown in FIG. 11 to designate parts or elements corresponding to those shown in FIG. 2

As shown in FIG. 11, in this micro-vacuum tube, an array of emitters 103 is so arranged as to become rough in the vicinity of a center of the substrate 102 and dense at a peripheral edge of the substrate 102. The center of the substrate 102 is particularly heated by radiation heat from the anode by such an emitter array, electron emission characteristics of the emitter are particularly varied at the center to suppress concentration of the current at the center, thereby making electron emission in the substrate surface uniform.

Features of the micro-vacuum tube according to the fourth aspect of the present invention will be described.

Figure 12:
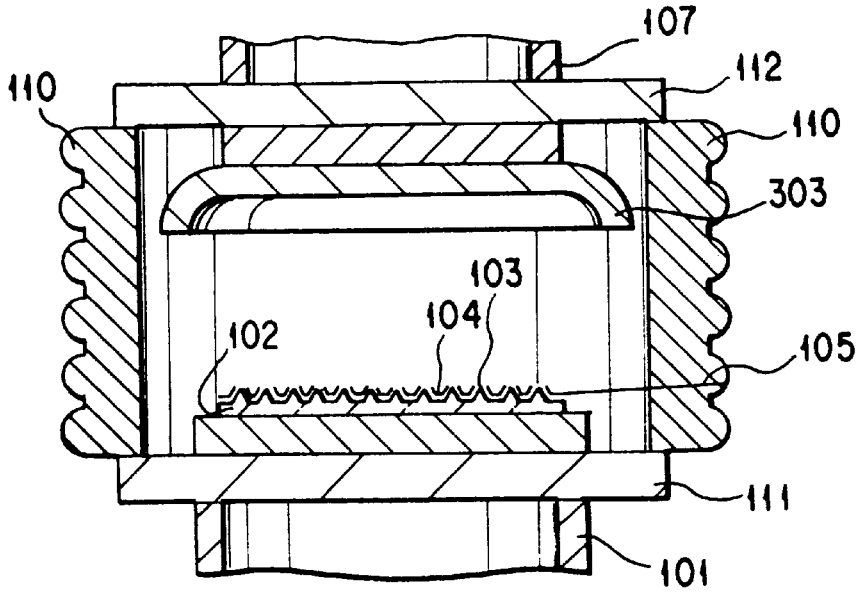
FIG. 12 is a schematic view showing a portion of a micro-vacuum tube according to a fourth aspect of the invention.

FIG. 12 is a schematic sectional view showing a portion of the micro-vacuum tube according to the fourth aspect of the present invention. The reference numerals are employed in the micro-vacuum tube shown in FIG. 12 to designates parts or elements corresponding to those in FIG. 2.

As shown in FIG. 12, an anode 303 used in this micro-vacuum tube has a dome shape. The dome shape is so designed that arrival distances of electrons emitted from the emitter 103 become substantially equivalent. Thus, the centers of the substrate and the anode having near electron arrival distances are locally heated with respect to peripheral edges thereof having farther electron arrival distances and hence electron emission characteristics of the emitter are varied to prevent concentration of the current at the centers. Thus, the electron emissions in the substrate surface can be made uniform.

Features of the micro-vacuum tube according to the fifth aspect of the present invention will be described.

Figure 13:
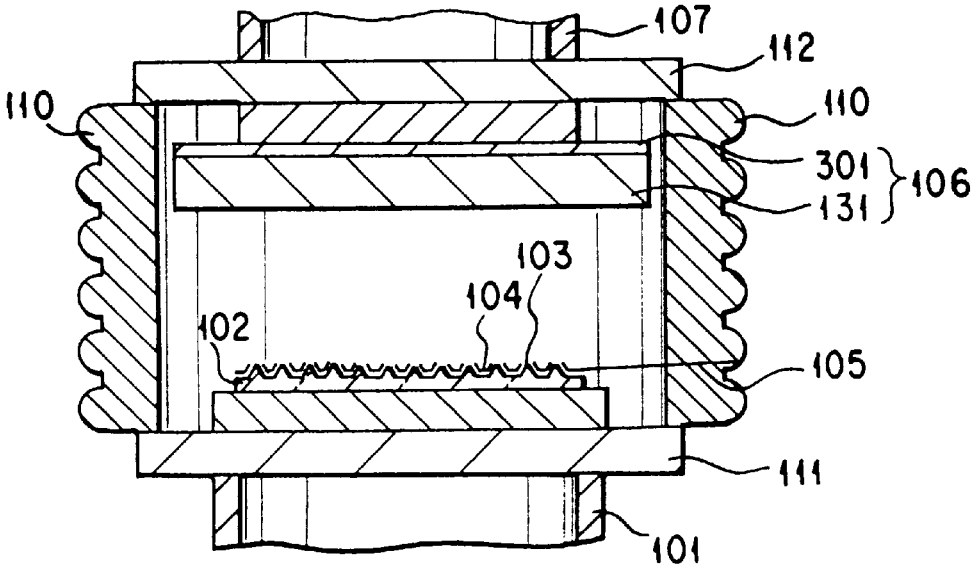
FIG. 13 is a schematic view showing a portion of a micro-vacuum tube according to a fifth aspect of the invention.

FIG. 13 is a schematic sectional view showing a portion of a micro-vacuum tube according to the fifth aspect of the present invention. In the drawing, the same reference numerals are employed in FIG. 13 to designate parts or elements corresponding to those shown in FIG. 10.

As shown in FIG. 13, the micro-vacuum tube according to the fifth aspect of the present invention has a structure substantially similar to that of the micro-vacuum tube shown in FIG. 10 except that a layer 131 made of a sintered material or porous conductive material having high thermal conductivity is used instead of the semiconductor layer 302.

The sintered material layer may be formed, for example, of silicon nitride, aluminum nitride or silicon carbide. The backing layer may be formed of aluminum, copper or the like. A suitable amount of powder of sintered material similar to the sintered material used for the sintered material layer as a filler is mixed within the backing layer. Thus, a thermal expansion difference between the backing layer and the sintered material layer is reduced, and adhesive properties therebetween are improved, and hence damage, fracture can be prevented. Since the sintered material having high thermal conductivity are used, heat generated at the cathode can be easily diffused.

As the porous conductive material, porous silicon, porous gold, porous aluminum, porous gallium arsenide having porosity of 20 to 80% may be employed. In the porous conductive material, the electrons emitted from the emitter are introduced into the pores of the porous conductive material, and heat is generated in a wider area. Thus, local heat generation on the surface of the anode and damage, fracture of the anode due to it can be avoided.

In the micro-vacuum tube described above, even if the current density to be used is large, heat generation in the anode, the emitter and the gate electrode in the large-current micro-vacuum microelement can be sufficiently suppressed. Therefore, the large-current micro-vacuum microelement can be used with the large current, has high withstand voltage, and sufficiently used as the element having a high speed switching. Since the variation in the electron emission characteristics of the emitter due to the local heat generation and the current concentration at the surface of the anode can be prevented, the damage, fracture of particularly the anode of the micro-vacuum tube can be avoided. Further, adverse influence to a peripheral equipment due to the heat generation can be prevented. Such a micro-vacuum tube can be used as a power switching element, and used additionally, for example, as a display unit.

Additional advantages and modifications will readily occur to those skilled in the art. Therefore, the invention in its broader aspects is not limited to the specific details, and representative devices shown and described herein.

Accordingly, various modifications may be made without departing from the spirit or scope of the general inventive concept as defined by the appended claims and their equivalents.

What is claimed is:

1. A micro-vacuum power switching device comprising:

a vacuum defined by a top seal, a bottom seal and an insulating enclosure which is provided between the seals;

a substrate provided on said bottom seal;

an emitter formed on said substrate and having a sharp tip;

a gate electrode formed in a region except for a tip region of said emitter, which is located above said substrate; and an anode provided on said top seal, wherein regions between said gate electrode and said anode are in a vacuum atmosphere state, and switching is operated by controlling a voltage applied to said gate electrode and anode.

2. A device according to claim 1, which is a large-current device, and further comprising: cooling means for cooling said anode.

3. A device according to claim 2, further comprising: cooling means for cooling said emitter and gate electrode.

4. A device according to claim 2, wherein said cooling means comprises one or a plurality of heat radiating fins.

5. A device according to claim 1, wherein said emitter has pyramidal shape.

6. A device according to claim 1, wherein said emitter is selected from a group consisting of tungsten, molybdenum, silicon, tantalum and lanthanum hexaboride.

7. A device according to claim 1, wherein said semiconductor is selected from a group consisting of silicon and gallium arsenide.

8. A device according to claim 1, wherein said anode including said semiconductor comprises a backing layer made of metal.

9. A device according to claim 8, wherein said metal is selected from a group consisting of aluminum, copper, gold, nickel, iron, and stainless steel.

10. A device according to claim 1, wherein said semiconductor contains an impurity doped to have a concentration gradient in a thickness direction of said anode.

11. A device according to claim 10, wherein said impurity is selected at least from a group consisting of boron and phosphorus.

12. A device according to claim 1, wherein said emitter discharges a current density of 100 A/cm$^2$ or higher.

13. A device according to claim 1, further comprising an insulating enclosure made of ceramics.

14. A device according to claim 1, further comprising a plurality of emitters on said substrate.

15. A device according to claim 1, further comprising a top seal, a bottom seal and an insulating enclosure which is provided between the seals, said top seal, said bottom seal and said insulating enclosure defining a vacuum space, and said substrate being provided on said bottom seal.

16. A device according to claim 15, wherein said top seal is made of a metal.

17. A device according to claim 1, wherein said anode is supported by a supporter having a top seal.

18. A device according to claim 1, wherein said anode is joined to said supporter by one of press bonding and brazing.

19. A device according to claim 1, further comprising cooling means connected to a top seal.

20. A micro-vacuum power switching device comprising:

a vacuum space defined by a top seal, a bottom seal and an insulating enclosure made of ceramic and provided between the seals;

a substrate provided on said bottom seal;

an emitter formed on said substrate and having a sharp tip;

a gate electrode formed in a region except for a tip region of said emitter, which is located above said substrate;

an anode provided on said top seal;

wherein regions between said gate electrode and said anode are in a vacuum atmosphere state, and switching is operated by controlling a voltage applied to said gate electrode and anode.

21. A device according to claim 20, wherein said emitter discharges a current density of 10 A/cm$^2$ or higher.

22. A device according to claim 20, wherein said insulating enclosure is made of ceramics.

23. A device according to claim 20, further comprising a plurality of emitters on said substrate.

24. A device according to claim 20, wherein said top seal is made of a metal.

25. A device according to claim 20, wherein said anode is supported by a supporter having a top seal.

26. A device according to claim 25, wherein said anode is joined to said supporter by one of press bonding and brazing.

27. A device according to claim 20, further comprising cooling means connected to the top seal.

28. A micro-vacuum power switching device comprising:

a vacuum space defined by a top seal, a bottom seal and an insulating enclosure which is provided between the seals;

a substrate provided on said bottom seal;

an emitter formed on said substrate and having a sharp tip;

a gate electrode formed in a region except for a tip region of said emitter, which is located above said substrate;

an anode provided on said top seal;

wherein regions between said gate electrodes and said anode are kept in a vacuum atmosphere, said emitter discharge a current density of 100 A/cm$^2$ or higher, and switching is operated by controlling a voltage applied to said gate electrode and anode.

* * * * *